US012392108B1

(12) United States Patent
Brochu et al.

(10) Patent No.: US 12,392,108 B1
(45) Date of Patent: Aug. 19, 2025

(54) SHOVEL LIFTING APPARATUS AND METHOD FOR LIFTING A SUPERSTRUCTURE OF A SHOVEL

(71) Applicant: 8082464 CANADA INC., Quebec (CA)

(72) Inventors: Jonathan Brochu, Saint-Lambert-de-Lauzon (CA); Stephane Cote, Quebec (CA); Camilo Gabriel Sanchez Munoz, Quebec (CA); Even Cloutier, Québec (CA)

(73) Assignee: 8082464 CANADA INC., Quebec (CA)

( * ) Notice: Subject to any disclaimer, the term of this patent is extended or adjusted under 35 U.S.C. 154(b) by 0 days.

(21) Appl. No.: 18/647,875

(22) Filed: Apr. 26, 2024

Related U.S. Application Data

(60) Provisional application No. 63/554,423, filed on Feb. 16, 2024.

(51) Int. Cl.
*E02F 9/00* (2006.01)
*E02F 9/10* (2006.01)

(52) U.S. Cl.
CPC ..... *E02F 9/10* (2013.01)

(58) Field of Classification Search
CPC . E02F 3/3631; E02F 9/08; E02F 9/003; E02F 9/10; B66F 3/46; B66F 2700/05; B66F 7/20; G05B 19/058
See application file for complete search history.

(56) References Cited

U.S. PATENT DOCUMENTS 2,640,562 A * 6/1953 Villars ..... B66F 7/025 187/214
2,958,508 A * 11/1960 Martinez ..... E02F 9/003 254/89 R
3,858,688 A * 1/1975 Galloway ..... B66F 11/04 187/244
3,881,687 A * 5/1975 Johansson ..... E02B 17/0863 254/108

(Continued)

FOREIGN PATENT DOCUMENTS

CA 2963671 C 4/2015
WO 2006086300 A2 8/2006

*Primary Examiner* — Edwin J Toledo-Duran
(74) *Attorney, Agent, or Firm* — Andrus Intellectual Property Law, LLP

(57) ABSTRACT

There is provided a method of lifting a shovel comprising an undercarriage and a superstructure with a counterweight. The method comprises configuring the shovel and a front lifting assembly and a rear lifting assembly on a lifting site in a lifting configuration wherein the front lifting assembly matches corresponding force applying points on a front portion of an undersurface of the superstructure and the rear lifting assembly matches corresponding force applying points on an undersurface of the counterweight, wherein at least one of the front and the rear lifting assemblies includes a lifting beam including a set of spaced-apart lifting units and an elongated beam extending inbetween; contacting the front lifting assembly and the rear lifting assembly with the corresponding force applying points on the undersurface of the front portion of the superstructure and the undersurface (Continued)

of the counterweight respectively; and starting a lifting operation to raise the superstructure to a desired height. There is also provided an apparatus for lifting the shovel from the ground surface.

20 Claims, 14 Drawing Sheets

(56) References Cited

U.S. PATENT DOCUMENTS 3,958,664 A * 5/1976 Perkins ..... B66F 7/025 187/214
4,106,634 A * 8/1978 Becker ..... B66F 7/08 414/508
4,251,974 A * 2/1981 Vanderklaauw ..... E04B 1/3511 52/125.1
4,330,105 A * 5/1982 Gallagher ..... B66F 7/025 254/89 R
4,600,085 A * 7/1986 Gagnon ..... E04H 3/26 472/78
4,793,593 A * 12/1988 Pittman ..... B66F 3/24 254/89 H
4,930,750 A * 6/1990 De Castro ..... E04G 23/065 254/89 H
4,930,937 A * 6/1990 Fulton ..... E02D 29/045 249/11
5,271,604 A * 12/1993 de Castro ..... E04G 23/065 254/89 H
5,299,658 A * 4/1994 Cox ..... B66F 7/04 187/209
5,868,544 A * 2/1999 Cox ..... B65G 69/24 414/398
5,915,912 A * 6/1999 Parnes ..... B66F 9/10 414/667
6,193,219 B1 * 2/2001 Belley ..... B66F 7/20 254/89 R
6,543,331 B1 * 4/2003 Zingerman ..... F15B 15/16 91/519
6,688,481 B1 * 2/2004 Adner ..... B60K 6/32 180/65.265
6,695,287 B1 * 2/2004 De Boer ..... B66F 7/08 254/10 C
6,705,595 B2 * 3/2004 Belley ..... E02F 9/003 254/108
6,871,412 B2 * 3/2005 Markeson ..... B23Q 1/0054 254/89 R
6,946,968 B1 * 9/2005 Johnson ..... F15B 15/2807 73/1.79
7,097,152 B2 * 8/2006 Klein ..... B65D 90/14 254/89 H
7,343,846 B2 * 3/2008 Stanford ..... F15B 15/24 92/18
RE41,554 E * 8/2010 Baker ..... B66F 7/20 187/210
8,251,184 B2 * 8/2012 De Jong ..... B66F 7/16 187/210
8,567,761 B2 * 10/2013 De Jong ..... B66F 3/46 254/2 B
9,015,969 B2 * 4/2015 Knuth ..... E02F 3/3677 37/444
9,045,150 B2 * 6/2015 Li ..... B61K 5/04
9,223,302 B2 * 12/2015 Maurer ..... H02P 29/60
9,334,145 B2 * 5/2016 Fagan ..... B66F 7/10
9,625,080 B1 * 4/2017 Youngers ..... B66F 3/25
9,796,568 B1 * 10/2017 Gonzales ..... F16M 11/32
10,005,648 B2 * 6/2018 Weiss ..... H04W 24/08
10,472,095 B1 * 11/2019 Vance ..... B66F 9/063
10,562,745 B2 * 2/2020 Veresko ..... B66F 7/10
11,708,251 B2 * 7/2023 Nooren ..... B66F 3/25 254/93 R
11,793,106 B2 * 10/2023 Tollefsrud ..... A01C 7/208
11,851,309 B2 * 12/2023 Belley ..... E02F 3/3631
12,103,831 B2 * 10/2024 Belley ..... B66F 7/28
2001/0004109 A1 * 6/2001 Belley ..... E02F 9/003 254/89 H
2002/0017637 A1 * 2/2002 Belley ..... E02F 9/003 254/89 H
2013/0240300 A1 * 9/2013 Fagan ..... B66F 3/46 187/203
2014/0324214 A1 * 10/2014 Elliott ..... B66F 13/00 254/89 R
2015/0076432 A1 * 3/2015 Farquharson ..... B66F 3/24 254/93 A
2015/0246797 A1 * 9/2015 Jaipaul ..... B66F 3/46 700/213
2016/0152454 A1 * 6/2016 Stapensea ..... B66F 9/20 254/89 R
2017/0081158 A1 * 3/2017 Jaipaul ..... H01Q 1/007
2017/0241126 A1 * 8/2017 Konduc ..... E04B 1/3511
2018/0290634 A1 * 10/2018 Belley ..... B66F 5/04
2019/0292028 A1 * 9/2019 Sung ..... E02B 17/08
2019/0316417 A1 * 10/2019 Krelifaoui ..... E21B 7/024
2019/0330804 A1 * 10/2019 Miguelez Tapia ..... E01B 29/17
2020/0055555 A1 * 2/2020 Williams ..... E21B 15/003
2020/0122987 A1 * 4/2020 Belley ..... E02F 9/08
2020/0140247 A1 * 5/2020 Jaipaul ..... B66F 3/46
2020/0407204 A1 * 12/2020 Hudson ..... B66F 3/46
2021/0119455 A1 * 4/2021 Jaipaul ..... H02J 7/00306
2021/0122619 A1 * 4/2021 De Jong ..... B66F 7/20
2021/0380379 A1 * 12/2021 Nooren ..... B66F 3/25
2022/0048745 A1 * 2/2022 Belley ..... B66F 7/20
2022/0153559 A1 * 5/2022 Kocian ..... B66C 23/76
2022/0185640 A1 * 6/2022 Schiphorst ..... B66F 1/025

* cited by examiner

SHOVEL LIFTING APPARATUS AND METHOD FOR LIFTING A SUPERSTRUCTURE OF A SHOVEL

CROSS-REFERENCE TO RELATED APPLICATIONS

This application claims priority under 35USC$119 (e) of U.S. provisional patent application 63/554,423, the specification of which is (are) hereby incorporated by reference.

TECHNICAL FIELD OF THE INVENTION

The technical field relates generally to raising heavy equipment and, more particularly, to a method and an apparatus allowing to safely raise a superstructure of a shovel.

BACKGROUND

From time to time, shovels (also referred to as excavators) need to be lifted for servicing purposes. For instance, the superstructure (upper part) of the shovel may need to be separated and lifted from the undercarriage (i.e. the lower part or the tractor) to access and, optionally, remove the undercarriage from underneath the superstructure, i.e. underdecking. For instance, the superstructure may be lifted from the undercarriage to provide access to the hydraulic shovel's rolling circle, which needs to be serviced at intervals. To do so, the superstructure (upper part) is separated from the undercarriage. This operation requires a lot of time and effort and in doing so; there is a great advantage to the owner if the lifting method utilized does not involve dismantling of the shovel's front attachments, including the shovel dipper (or bucket).

There is a need for shovel lifting method and apparatus that are at least one of quicker for performing a lifting operation, safer, and provide easy access to the shovel components for maintenance purposes.

BRIEF SUMMARY OF THE INVENTION

It is therefore an aim of the present invention to address the above-mentioned issues.

According to a general aspect, there is provided a method of lifting a shovel comprising an undercarriage, a superstructure with a counterweight, and a bucket mounted to the superstructure. The method comprises: configuring the shovel and a lifting system including a set of front lifting units and a lifting beam including a set of spaced-apart rear lifting units on a lifting site in a lifting configuration wherein the set of front lifting units matches corresponding force applying points on a front portion of the superstructure and the lifting beam matches corresponding force applying points on the counterweight; contacting the set of front lifting units and the lifting beam with the corresponding force applying points on the front portion of the superstructure and the counterweight respectively; and starting a lifting operation to raise the superstructure to a desired height. In an embodiment, the bucket and the front attachments remains mounted to the superstructure for a duration of the lifting operation.

In an embodiment, contacting the set of front lifting units and the lifting beam with the corresponding force applying points on the front portion of the superstructure and the counterweight comprises extending the set of front lifting units and the set of rear lifting units of the lifting beam.

In an embodiment, contacting the set of front lifting units and the lifting beam with the corresponding force applying points on the front portion of the superstructure and the counterweight comprises adding front and rear shims to upper surfaces of the front lifting units and the lifting beam.

In an embodiment, configuring the shovel and the lifting system in the lifting configuration at the lifting site comprises positioning the front lifting units at the lifting site and, then, driving the shovel at a lifting position at the lifting site, the front lifting units being located forwardly of a carbody of the undercarriage and inwardly of two endless tracks of the undercarriage. Configuring the shovel and the lifting system in the lifting configuration at the lifting site can comprise positioning the lifting beam with the rear lifting units of the lifting beam being positioned outwardly of the two endless tracks. Configuring the shovel and the lifting system in the lifting configuration at the lifting site can comprise positioning the rear lifting units at the lifting site and, then, driving the shovel at the lifting position at the lifting site and securing an elongated beam of the lifting beam to respective upper portions of the positioned rear lifting units.

In an alterative embodiment, configuring the shovel and the lifting system in the lifting configuration at the lifting site can comprise driving the shovel at the lifting position to the lifting site and, then, positioning the lifting beam at the lifting site rearwardly of the shovel, with an elongated beam of the lifting beam extending below the counterweight.

In an embodiment, the method further comprises, following positioning the shovel at a lifting position at the lifting site, detaching the superstructure from the undercarriage.

In an embodiment, the method further comprises, lowering the bucket mounted to the superstructure onto a supporting surface and maintaining the bucket on the supporting surface and mounted to the superstructure for a duration of the lifting operation.

According to another general aspect, there is provided an apparatus for lifting a shovel from a ground surface, the shovel comprising an undercarriage and a superstructure with a counterweight. The apparatus comprises: a set of front lifting units abuttable against an undersurface of a front portion of the superstructure; a lifting beam including a set of rear lifting units and an elongated beam extending between upper portions of the rear lifting units, a spacing between the rear lifting units being greater than a width of the undercarriage, the lifting beam being abuttable against an undersurface of the counterweight; and a control unit operatively connected to the set of front lifting units and the lifting beam.

In an embodiment, the shovel further comprises a bucket mounted to the superstructure, the bucket remaining mounted to the superstructure when lifting the shovel with the apparatus.

According to still another general aspect, there is provided a method of lifting a shovel comprising an undercarriage and a superstructure with a counterweight. The method comprises: configuring the shovel and a lifting system including a front lifting assembly and a rear lifting assembly on a lifting site in a lifting configuration wherein the front lifting assembly matches corresponding force applying points on a front portion of an undersurface of the superstructure and the rear lifting assembly matches corresponding force applying points on an undersurface of the counterweight, wherein at least one of the front and the rear lifting assemblies includes a lifting beam including a set of spaced-apart lifting units and an elongated beam extending inbetween; contacting the front lifting assembly and the rear lifting assembly with the corresponding force applying points on the front portion of the undersurface of the superstructure and the undersurface of the counterweight respectively; and starting a lifting operation to raise the superstructure to a desired height.

In an embodiment, the shovel comprises a bucket mounted to the superstructure and the bucket remains mounted to the superstructure for the duration of the lifting operation.

In an embodiment, the front lifting assembly comprises a set of front lifting units and the rear lifting assembly comprises the lifting beam with the set of lifting units and the elongated beam, wherein contacting the front lifting assembly and the rear lifting assembly with the corresponding force applying points on the front portion of the superstructure and the counterweight comprises extending the set of front lifting units to contact the undersurface of the superstructure and the set of lifting units of the lifting beam to contact the undersurface of the counterweight. Contacting the set of front lifting units and the lifting beam with the corresponding force applying points on the front portion of the superstructure and the counterweight can comprise adding front and rear shims to upper surfaces of the front lifting units and the lifting beam.

In an embodiment, configuring the shovel and the lifting system in the lifting configuration at the lifting site comprises positioning the front lifting assembly at the lifting site and, then, driving the shovel at a lifting position at the lifting site, the front lifting assembly being located f forwardly of a carbody of the undercarriage and inwardly of two endless tracks of the undercarriage. Configuring the shovel and the lifting system in the lifting configuration at the lifting site can comprise positioning the lifting beam with the lifting units of the lifting beam being positioned outwardly of the two endless tracks. It can also comprise positioning the lifting units of the lifting beam at the lifting site and, then, driving the shovel at the lifting position at the lifting site and securing the elongated beam of the lifting beam to respective upper portions of the positioned lifting units of the lifting beam, the lifting beam extending below the counterweight. Alternatively, it can also comprise driving the shovel at the lifting position to the lifting site and, then, positioning the lifting beam at the lifting site rearwardly of the shovel, with the elongated beam of the lifting beam extending below the counterweight.

In n an embodiment, the method further comprises, following positioning the shovel at a lifting position at the lifting site, detaching the superstructure from the undercarriage. The method can further comprise driving at least one of rearwardly, forwardly and laterally the undercarriage under the lifting beam and outside the lifting site once the superstructure is raised.

In an embodiment, the method further comprises lowering the bucket mounted to the superstructure onto a supporting surface and maintaining the bucket on the supporting surface and mounted to the superstructure for a duration of the lifting operation.

According to a further general aspect, there is provided an apparatus for lifting a shovel from a ground surface, the shovel comprising an undercarriage and a superstructure with a counterweight. The apparatus comprises: a set of front lifting units abuttable against an undersurface of a front portion of the superstructure; a lifting beam including a set of rear lifting units and an elongated beam extending between upper portions of the rear lifting units, a spacing between the rear lifting units being greater than a width of the undercarriage, the lifting beam being abuttable against an undersurface of the counterweight; and a control unit operatively connected to the set of front lifting units and the lifting beam.

In an embodiment, the elongated beam of the lifting beam is detachable from the rear lifting units.

According to still a further general aspect, there is provided an apparatus for lifting a shovel from a ground surface, the shovel comprising an undercarriage and a superstructure with a counterweight. The apparatus comprises: a front lifting beam including a set of front lifting units and an elongated beam mounted to an upper portion of the front lifting units, extending inbetween, and abuttable against an undersurface of a front portion of the superstructure, a spacing between the front lifting units being greater than a width of the undercarriage; a rear lifting assembly abuttable against an undersurface of the counterweight; and a control unit operatively connected to the set of front lifting units and the rear lifting assembly.

In an embodiment, the elongated beam of the lifting beam is detachable from the front lifting units.

In an embodiment, the rear lifting assembly comprises a set of rear lifting units and an elongated beam securable to upper ends of the rear lifting units and abuttable, a spacing between the rear lifting units being greater than a width of the undercarriage and the elongated beam being abuttable against the undersurface of the counterweight. The elongated beam of the lifting beam of the rear lifting assembly can be detachable from the rear lifting units. The elongated beam can comprise two recesses extending inwardly from a lower surface of the elongated beam and wherein a distance between the two recesses substantially corresponds to a distance between endless tracks of the undercarriage of the shovel.

BRIEF DESCRIPTION OF THE DRAWINGS

It will be noted that throughout the appended drawings, like features are identified by like reference numerals.

DETAILED DESCRIPTION

Moreover, although the embodiments of the apparatus for lifting an upper part of a shovel and corresponding parts thereof consist of certain geometrical configurations as explained and illustrated herein, not all of these components and geometries are essential and thus should not be taken in their restrictive sense. It is to be understood, as also apparent to a person skilled in the art, that other suitable components and cooperation thereinbetween, as well as other suitable geometrical configurations, may be used for the shovel lifting apparatus, as will be briefly explained herein and as can be easily inferred herefrom by a person skilled in the art. Moreover, it will be appreciated that positional descriptions such as "above", "below", "left", "right" and the like should, unless otherwise indicated, be taken in the context of the figures and should not be considered limiting.

In the following description, the same numerical references refer to similar elements. Furthermore, for the sake of simplicity and clarity, namely so as to not unduly burden the figures with several references numbers, not all figures contain references to all the components and features, and references to some components and features may be found in only one figure, and components and features of the present disclosure which are illustrated in other figures can be easily inferred therefrom. The embodiments, geometrical configurations, materials mentioned and/or dimensions shown in the figures are optional, and are given for exemplification purposes only.

Moreover, it will be appreciated that positional descriptions such as "above", "below", "forward", "rearward" "left", "right" and the like should, unless otherwise indicated, be taken in the context of the figures and correspond to the position and orientation of the shovel lifting apparatus for lifting an upper part of a shovel, with the "front" corresponding to a position closer to a dipper (bucket) of the shovel and the "back"/"rear" corresponding to a position closer to a counterweight of the shovel. Positional descriptions should not be considered limiting.

Figure 1:
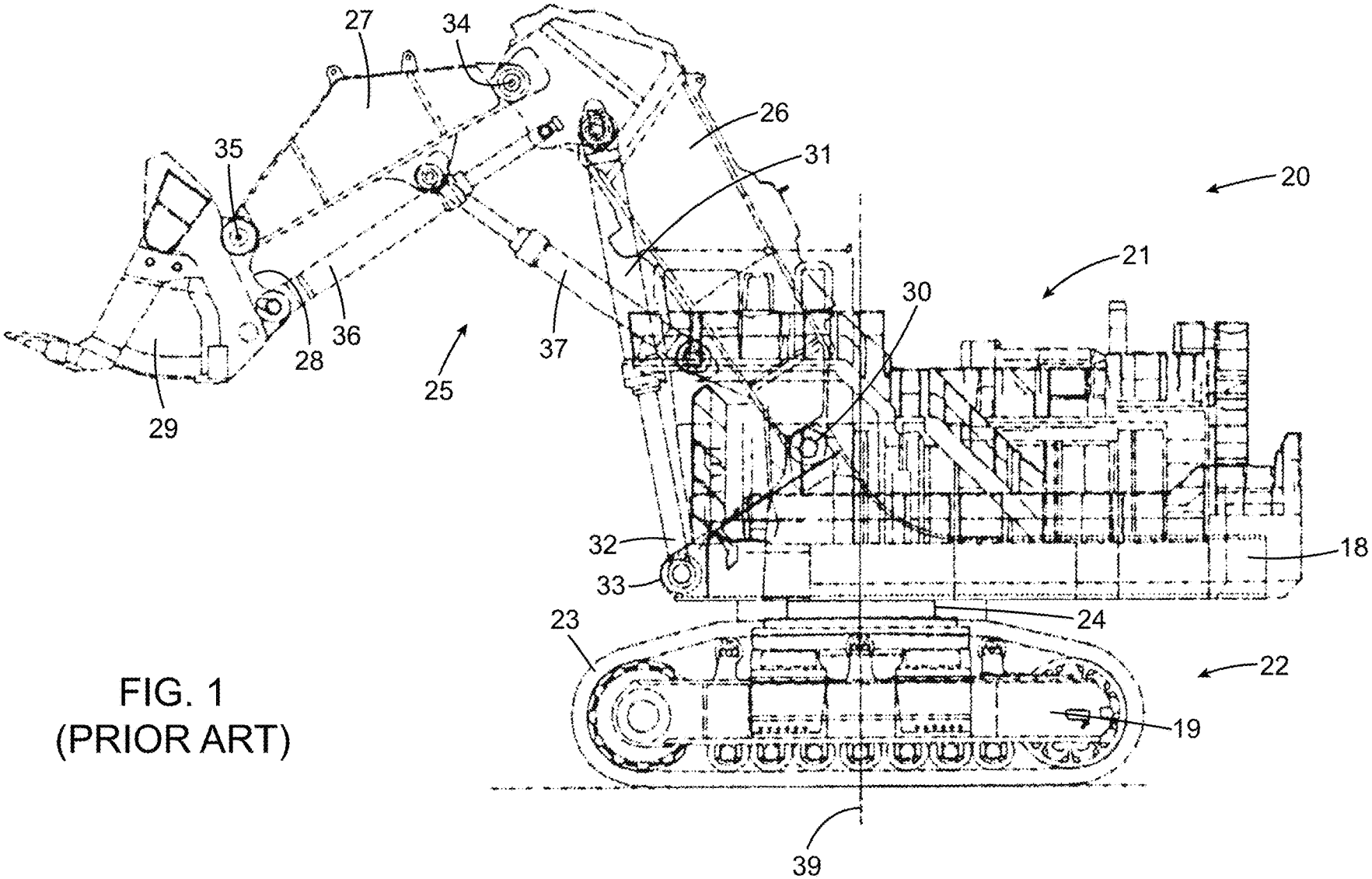
FIG. 1 (PRIOR ART)
FIG. 1 is a side elevation view of a hydraulic shovel of a type well known in the art.

Referring now to the drawings and more particularly to FIG. 1, there is shown generally at 20 a hydraulic shovel of a type well known in the art. It comprises a superstructure 21 (i.e. the upper part of the shovel) secured to an undercarriage 22 (also often referred to as the lower part of the shovel, a truck or a tractor) having two spaced-apart endless tracks 23 to displace the shovel 20 on a ground surface and a carbody 19. The superstructure 21 includes a counterweight 18 in a rear portion thereof and has front attachments 25 mounted to a front portion thereof. A rolling circle 24 is secured between the carbody 19 and the superstructure 21 to permit the superstructure 21 to revolve 360° around a central axis 39 of the shovel 20 in either direction left or right. The front attachments 25 include a boom 26, an arm 27 and a connector flange 28. The upper part further includes a bucket 29 (or a dipper), secured to the connector flange 28 of the front attachments 25. The boom 26 is articulated on a pivot 30 by a boom cylinder 31, which is herein shown fully extended and secured at a lower end 32 to a pivot attachment 33. The arm 27 is pivotally connected at one end 34 to a top end of the boom 26 and at an opposed end 35 to an end of the connector flange 28. A bucket control cylinder 36 is connected to the connector flange 28 to displace the bucket 29. A hydraulic cylinder 37 displaces the arm 27.

At regular intervals, such shovels need to be lifted for servicing purposes of components of their carbody 19. For instance, the rollers of the carbody 19 need to be replaced at regular intervals. Similarly, the sideframes of the carbody 19 eventually also need repairs or replacement. This type of maintenance requires a lot of time and effort and in doing so; there is a great incentive to be able to lift the superstructure 21 as a whole in a safe and easy manner.

In FIG. 1, the shovel 20 is a hydraulic shovel (or excavator) but it is appreciated that the shovel lifting apparatus can be used with a rope (or power or mining) shovel.

Figure 5:
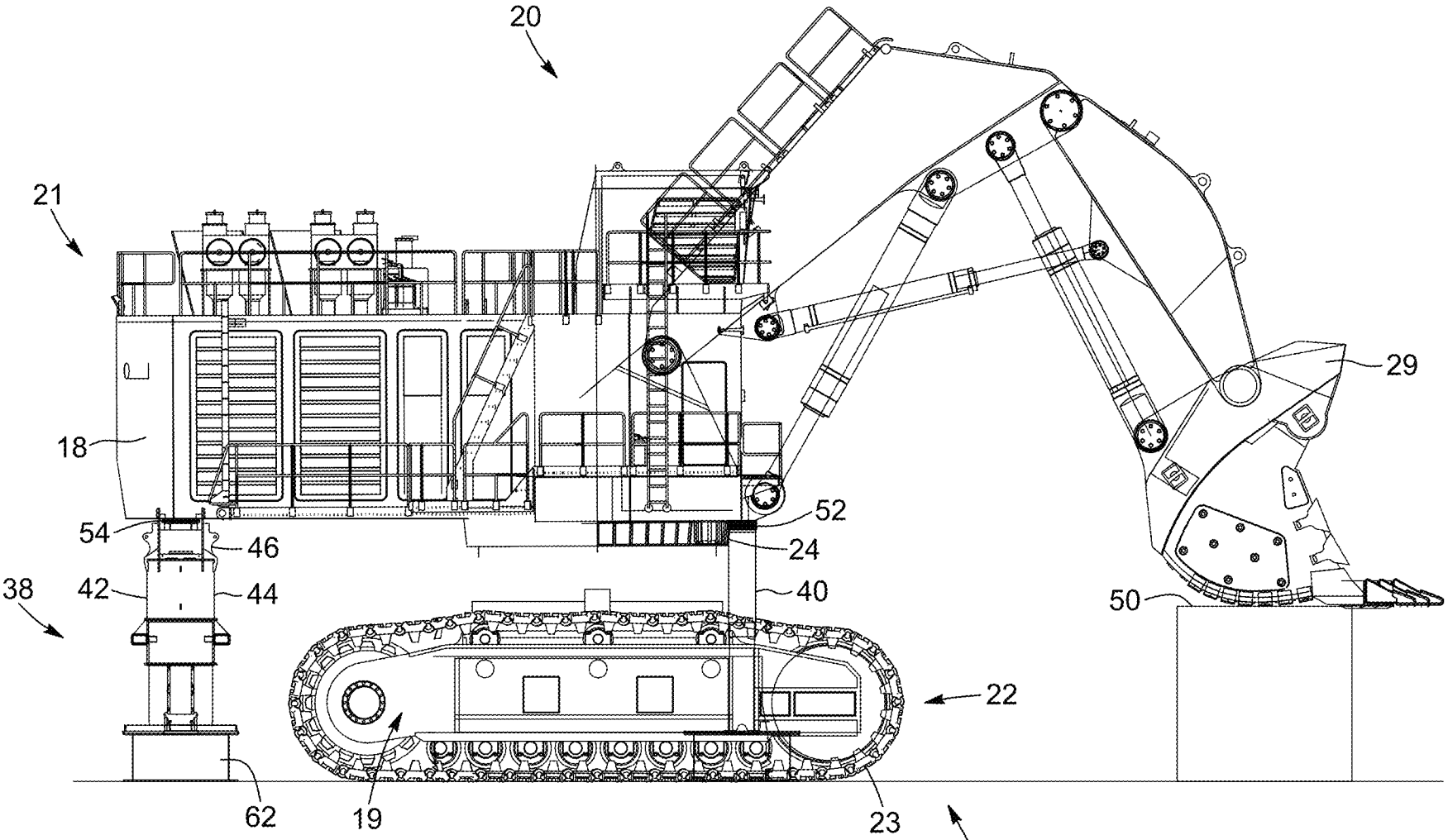
FIG. 5 is a side elevation view of the hydraulic shovel with the shovel lifting apparatus of FIG. 2, wherein a superstructure and an undercarriage of the shovel are detached and the superstructure is raised relative to the ground and the undercarriage.
Figure 6:
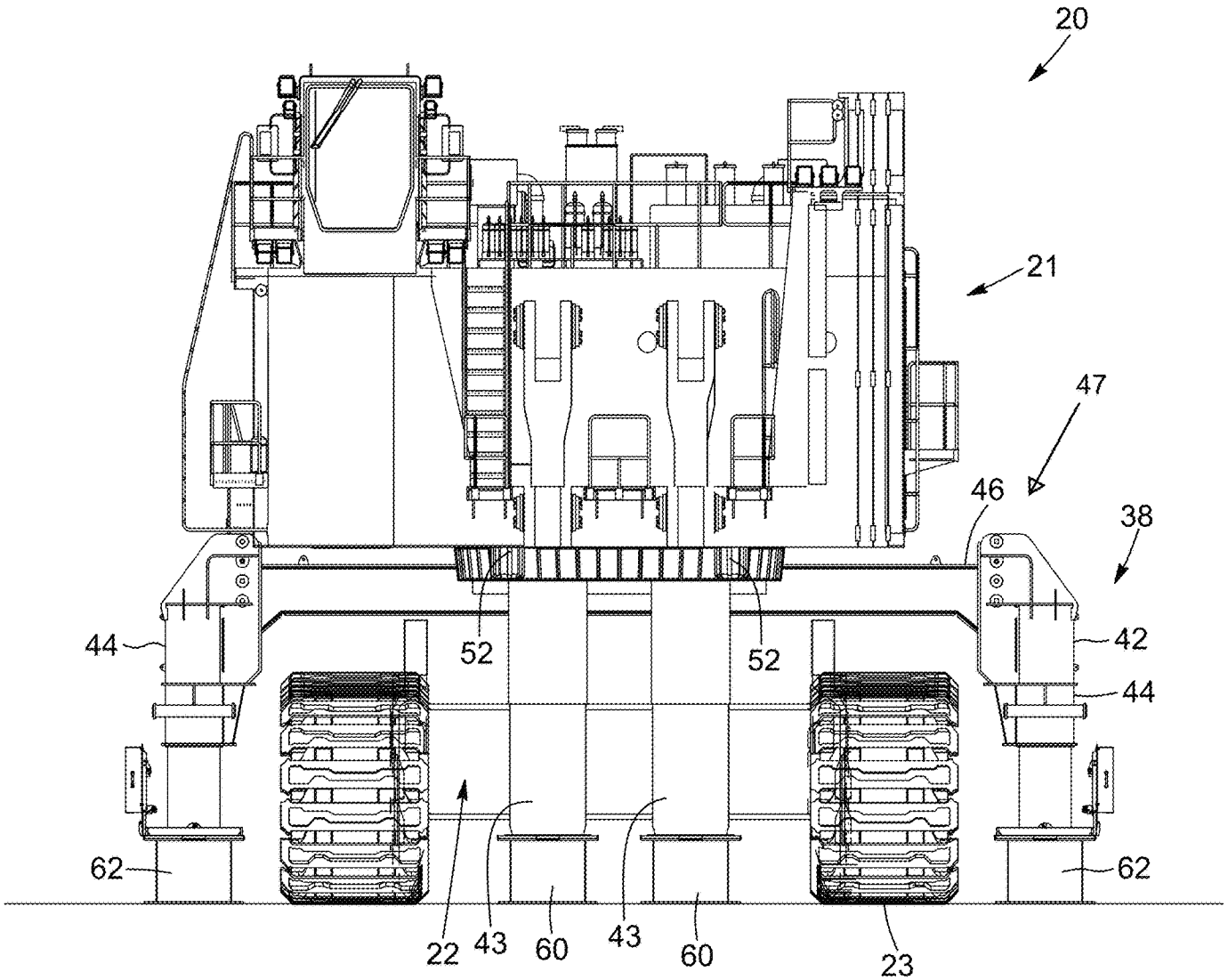
FIG. 6 is a front elevation view of the hydraulic shovel with the shovel lifting apparatus of FIG. 5, wherein the bucket and front attachments have been omitted.
Figure 7:
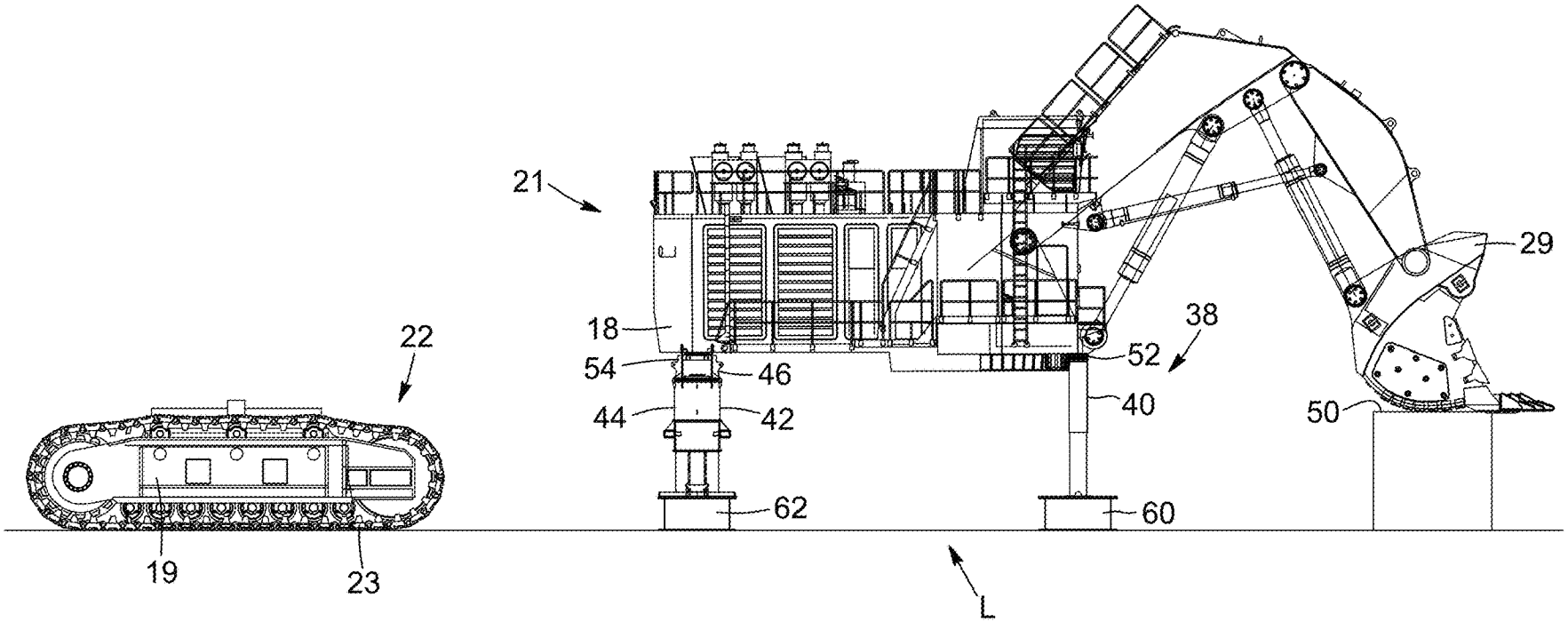
FIG. 7 is a side elevation view of the hydraulic shovel with the shovel lifting apparatus of FIG. 2, wherein the undercarriage is located behind the raised superstructure.
Figure 8:
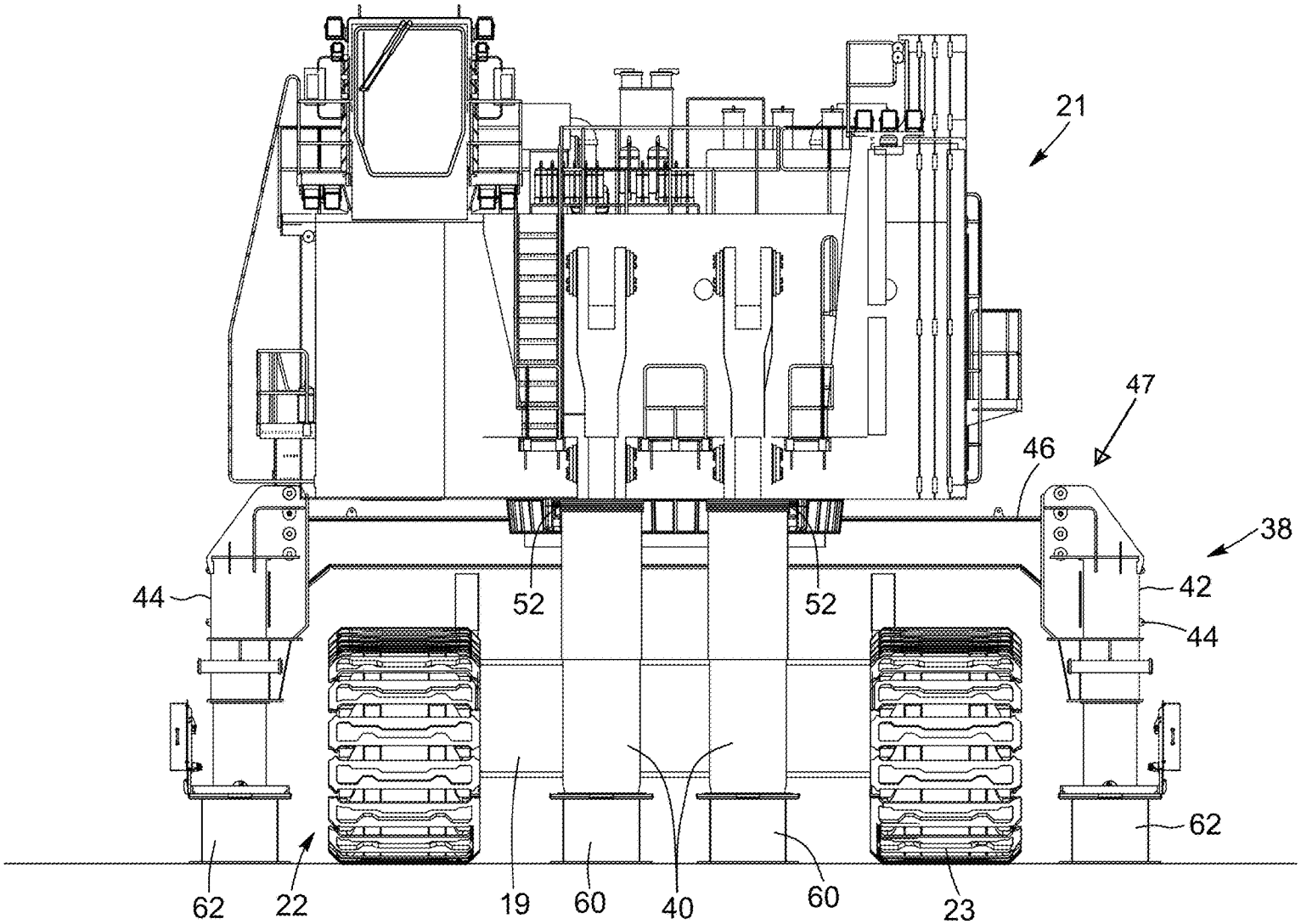
FIG. 8 is a front elevation view of the hydraulic shovel with the shovel lifting apparatus of FIG. 7, wherein the bucket and front attachments have been omitted.

Referring now to FIGS. 2 to 8, a method and a shovel lifting apparatus 38 to lift the superstructure 21, detached the undercarriage 22, and, optionally, withdraw the undercarriage 22 from under the superstructure 21 is shown (as shown in FIGS. 7 and 8).

Figure 2:
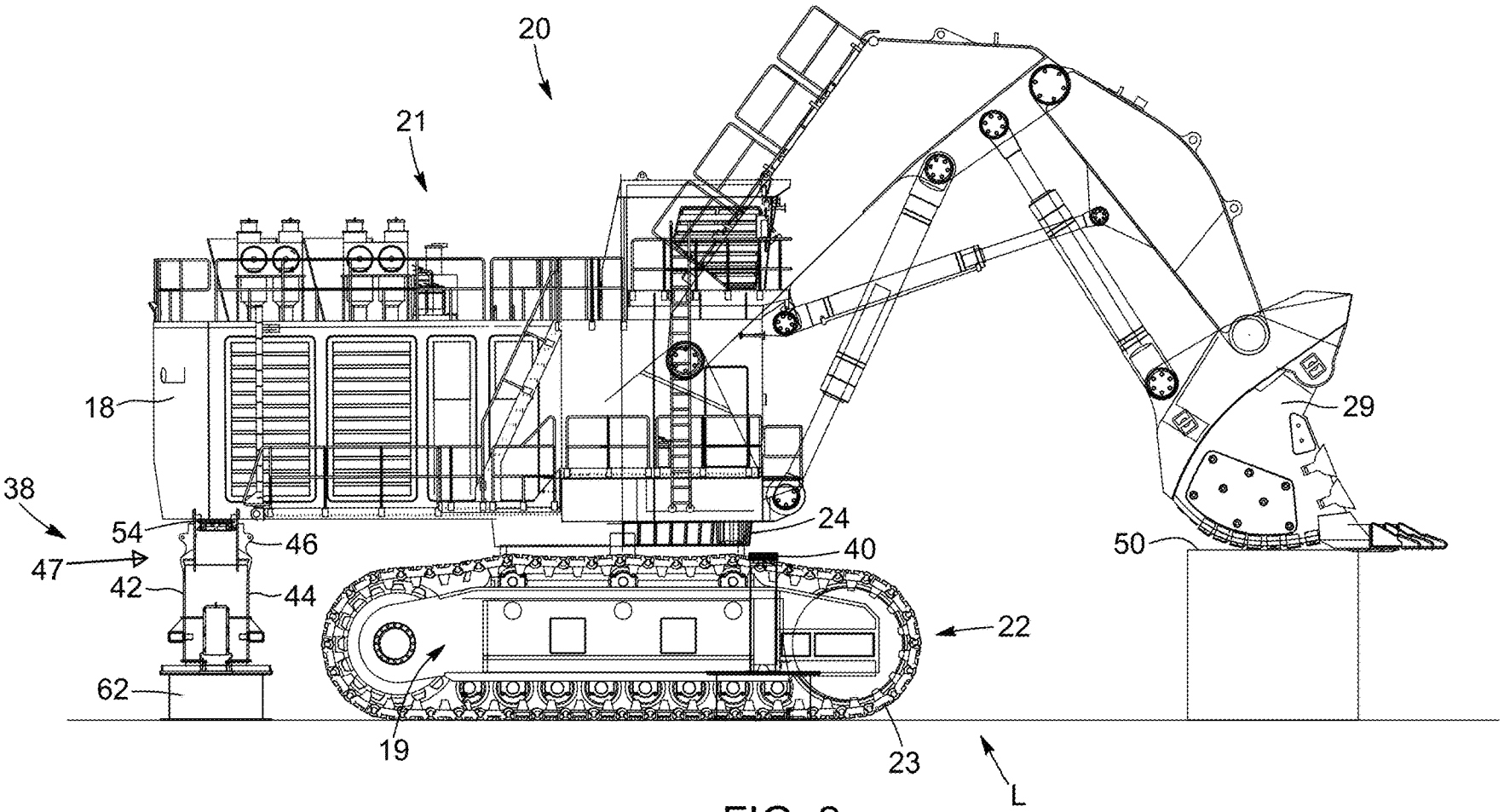
FIG. 2 is a side elevation view of a hydraulic shovel with a shovel lifting apparatus in accordance with an embodiment prior to a lifting operation a lifting configuration at a lifting site.
Figure 3:
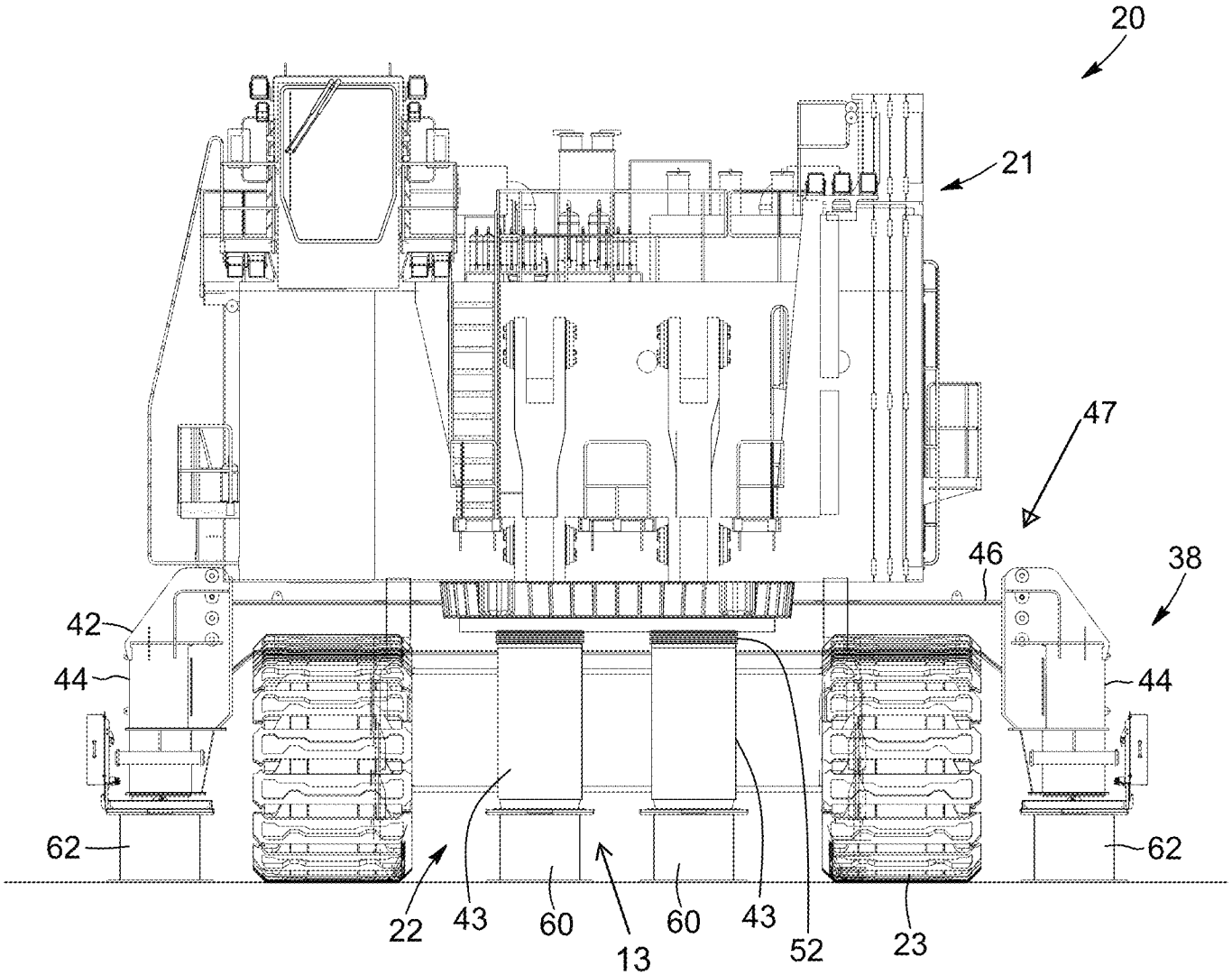
FIG. 3 is a front elevation view of the hydraulic shovel with the shovel lifting apparatus of FIG. 2, wherein a bucket and front attachments of the shovel have been omitted.
Figure 4:
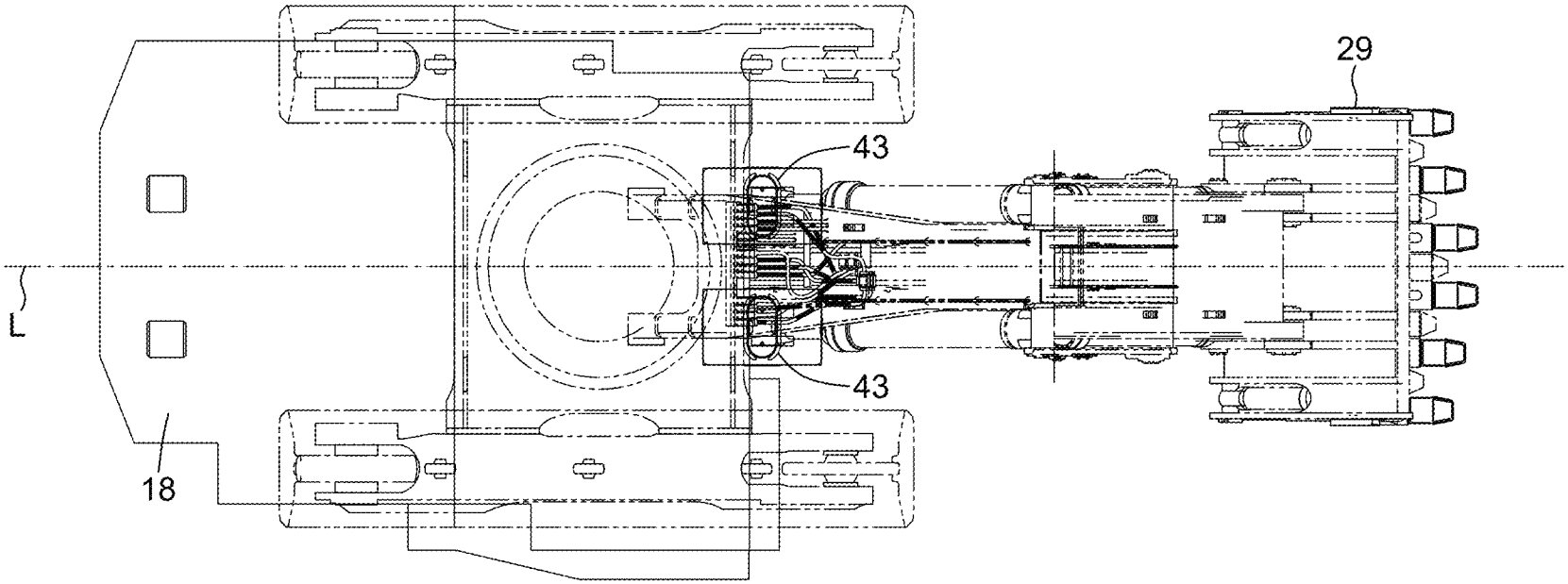
FIG. 4 is a top plan view of the hydraulic shovel with the shovel lifting apparatus of FIG. 2.

Turning now to FIGS. 2 to 4, there is shown that the shovel lifting apparatus 38 includes a front lifting assembly 40 and a rear lifting assembly 42. The shovel 20 and the shovel lifting apparatus 38 are configured in a lifting configuration at a lifting site L. In the lifting configuration, the shovel 20, the front assembly 40 and the rear lifting assembly 42 are in a relative configuration at the lifting site L. In the embodiment shown, the front lifting assembly 40 is first positioned at a selected position on the ground (or on a base supported on the ground), at the lifting site L. In the non-limitative embodiment shown, the front lifting assembly 40 includes two lifting units (such as lifting jacks), transversally spaced-apart from another. Then, the shovel 20 is moved, i.e. driven forwards, towards the front lifting assembly 40 and configured at a suitable position with respect to the front lifting assembly 40 in a manner such that the front lifting assembly 40 is located at least partially below the superstructure 21 of the shovel 20, forwardly of the carbody 19. In the embodiment shown wherein the front lifting assembly 40 includes two lifting units 43, the lifting units 43 are located inwardly of the two endless tracks 23, each being located on a respective side of a central longitudinal axis X (FIG. 4) of the shovel 20. Each one of the lifting units is located under the superstructure 21 of the shovel 20 configured to abut an undersurface of the superstructure undersurface of the superstructure and, in a particular embodiment, directly abuts the undersurface of the superstructure and configured to apply a vertical trust thereon.

In some embodiments, each one of the front lifting assembly 40 and the rear lifting assembly 42 can include front and rear shims 52, 54, as will be described in more details. The front and rear shims 52, 54 are insertable between either the lifting units or an elongated beam of the lifting assembly and an undersurface of the superstructure 21 or the counterweight 18.

It is appreciated that, in an alternative embodiment which will be described in more details below in reference to FIGS. 9 to 14, the front lifting assembly 40 can include a lifting beam extending between the two spaced-apart front lifting units. In such embodiment, each one of the front lifting units can be positioned on a respective side of the superstructure 21 of the shovel 20, outwardly of the two endless tracks 23, with the beam extending inbetween and under the superstructure 21, forwardly of the carbody 19. In such embodiment, the front lifting beam and, more particularly an elongated beam thereof is configured to abut the undersurface of the superstructure and, in a particular embodiment, directly abuts the undersurface of the superstructure and is configured to apply a vertical trust thereon.

Then, still referring to the embodiment shown in FIGS. 2 to 4, the rear lifting assembly 42 is positioned with respect to the shovel 20. More particularly, the rear lifting assembly 42 is positioned substantially aligned with a rear end of the counterweight 18 along the longitudinal axis X of the shovel 20. In the embodiment shown, the rear lifting assembly 42 includes a lifting beam 47.

The rear lifting assembly 42 includes two lifting units 44 (hereinafter referred to as the rear lifting jacks or the lifting beam jacks) and an elongated beam 46 extending between upper ends of the two rear lifting units 44.

In some implementations, for either the front lifting assembly 40 or the rear lifting assembly 42, the elongated beam can be detachable from the lifting units. For instance, in the embodiment shown in FIGS. 2 to 4 wherein the rear lifting assembly 42 includes the lifting beam 47, the rear lifting units 44 and the front lifting units 43 can be positioned simultaneously at the lifting site L and the elongated beam 46 can be secured to the rear lifting units 44 after positioning the shovel 20 between the four lifting units 40, 44. In the implementations wherein the elongated beam 46 is not detachable or easily detachable from the rear lifting units 44, the lifting beam 47 can be positioned after positioning the shovel 20 at its lifting position at the lifting site L. In the embodiment shown, each one of the rear lifting units 44 is positioned outwardly (along a transversal axis extending perpendicular to the longitudinal axis X of the shovel 20) of the two endless tracks 23 in a manner such that the undercarriage 22 including the endless tracks 23 can move between the rear lifting units 44. As for the front lifting units 43 of the front lifting assembly 40, the rear lifting units 44 are positioned on the ground (or on a base supported on the ground). For instance, if the elongated beam 46 is not secured to the rear lifting units 44 and the rear lifting units 44 are positioned at the lifting site L before the shovel 20, the shovel 20 can access its lifting position between the four lifting units 40, 44 via the space defined between the rear lifting units 44. Furthermore, if the undercarriage 22 is removed from under the superstructure 21 once the latter is raised (i.e. underdecking), as described in more details below, the undercarriage 22 can be removed from the lifting site L, once again, via the space defined between the rear lifting units 44 (or laterally).

Thus, if the rear lifting units 44 are positioned simultaneously with the front lifting units 43 of the front lifting assembly 40 and before positioning the shovel 20 at the lifting site L, once the shovel 20 is positioned at the lifting site L, the elongated beam 46 is mounted to the rear lifting units 44.

If the lifting beam 47 is provided as a single unit, the lifting beam 47 is positioned at the lifting site L once the shovel 20 is positioned at its lifting position.

In still an alternative embodiment, the shovel 20 can be first driven at its lifting position at the lifting site L. Then, the front lifting units 43 of the front lifting assembly 40 and the lifting beam 47 of the rear lifting assembly 42 can be positioned at their respective position at the lifting site L to configure the shovel, the front lifting assembly 40, and the rear lifting assembly 42 in their relative lifting configuration at the lifting site L.

In an alternative embodiment wherein the front lifting assembly includes a lifting beam and the rear lifting assembly includes two spaced-apart and detached lifting units, the front and the rear lifting units can be positioned simultaneously at the lifting site L and the elongated beam can be secured to the front lifting units after positioning the shovel 20 between the four lifting units. In an embodiment wherein the elongated beam is not detachable from the front lifting units, the front lifting beam can be positioned after positioning the shovel 20 at its lifting position at the lifting site L.

In an alternative embodiment wherein each one of the front lifting and the rear lifting assemblies includes a lifting beam and the rear lifting assembly includes two spaced-apart and detached lifting units, such as the one shown in FIGS. 9 to 14, if the elongated beams are detachable from the lifting units, the four lifting units can be first positioned at the lifting site L, the shovel 20 can be driven 20 at its lifting position at the lifting site L, and, then, the elongated beams can be secured to their respective lifting units. Alternatively, the shovel 20 can be driven at the lifting site L and, then, the lifting beams can be configured in the lifting configuration with respect to the shovel 20.

The lifting operation can begin once the shovel 20, the front lifting assembly 40 and the rear lifting assembly 42 are in the lifting configuration at the lifting site L. In the lifting configuration of the embodiment shown in FIGS. 2 to 4, the front lifting units 43 of the front lifting assembly 40 are transversally spaced-apart from another, located under the superstructure 21 of the shovel 20, vertically aligned therewith, forwardly of the carbody 19, inwardly of the two endless tracks 23, each being located on a respective side of a central longitudinal axis X (FIG. 4) of the shovel 20. In the lifting configuration, the lifting beam 47 of the rear lifting assembly 42 is positioned substantially aligned with a rear end of the counterweight 18 along the longitudinal axis X of the shovel 20, with each one of the rear lifting units 44 being positioned outwardly (along the transversal axis) of the two endless tracks 23. The elongated beam 46 extends under the counterweight 18. In the lifting configuration, each one of the front lifting units 43 of the front lifting assembly 40 and the lifting beam 47 are aligned with corresponding predetermined force applying or lifting points on the front portion of the superstructure 21 and the rear portion of the counterweight 18 and are configured to apply a vertical trust thereon.

In the non-limitative embodiment shown, the front and rear lifting units of the front and rear liftin assemblies 40, 44 are mounted front and rear bases 60, 62, which stabilize the lifting units during the lifting operation.

In some implementations, during the entire lifting and maintenance operations, the bucket 29 is kept on a supporting surface and mounted to the superstructure 21. The supporting surface can be the ground or a raised supporting surface 50, as shown in FIG. 2.

Therefore, at anytime once the shovel 20 is positioned at its lifting position and before beginning the lifting operation, the bucket 29 can be lowered and positioned on the supporting surface 50.

It is appreciated that, in other implementations, the bucket 29 can remain unsupported, above the ground, during the lifting and maintenance operations.

In further implementations, the bucket 29 or the front attachments 25 having the bucket 29 mounted thereto can be disconnected from the superstructure 21 during the lifting operation. Therefore, the superstructure 21 can lifted with the shovel lifting apparatus 38 without the bucket and, in some implementations, without the front attachments 25.

Before beginning the lifting operation, the front lifting units 43 of the front lifting assembly 40 and the lifting beam 47 are abutted against a front section of the superstructure 21 and the counterweight 18 respectively. More particularly, the front lifting units 43 of the front lifting assembly 40 and the elongated beam 46 of the lifting beam 47 abut against the undersurface of the superstructure 21 the counterweight 18 respectively. Abutting the front lifting units 43 of the front lifting assembly 40 and the lifting beam 47 can be performed by slightly raising the front and rear lifting units and/or by adding front and rear shims 52, 54 between an upper surface of the front lifting units 43 and the rear lifting beam 47 and the superstructure 21 and the counterweight 18 respectively to provide a contact therebetween, without raising the superstructure 21.

If required, the superstructure 21 can be detached from the undercarriage 22 at any time once the shovel 20 is at its lifting position. Therefore, the superstructure 21 can be lifted by the front and rear lifting assemblies 40, 42 while the undercarriage 22 remain stationary at the lifting position.

Still referring to FIGS. 2 and 3, there is shown the shovel 20, immobilized at its lifting position, in the lifting configuration with respect to the front lifting units 43 of the front lifting assembly 40 and the lifting beam 42 and in position to be lifted. More particularly, the front lifting units 43 of the front lifting assembly 40 and the lifting beam 42 precisely aligned with corresponding predetermined force applying or lifting points on the front portion of the superstructure 21 and the rear portion of the counterweight 18, underneath thereof. The bucket 29 is lowered and rest on the raised supporting surface 50. As mentioned above, in the non-limitative embodiment shown, the bucket 29 remains on the raised supporting surface 50 throughout the lifting operation. To do so, the pinion of the handle drive is put on neutral so that it will move freely inside the motorized handle connector frame during the lifting operation. The front lifting units 43 and the lifting beam 42 have been extended or front and rear shims 52, 54 have been added to the upper surface of t lifting units 43 and the lifting beam 54, respectively, to make contact with a bottom side of the superstructure 21 and the counterweight 18.

In the embodiment, the bucket 29 or the front attachments 25 having the bucket 29 mounted thereto can be disconnected from the superstructure 21 before beginning the lifting operation. Therefore, the lifting operation can be performed on the shovel 20 free of front attachments 25 and/or bucket 29.

The front and rear lifting units of the front and rear lifting assemblies 40, 44 are extended substantially synchronously to maintain the superstructure 21 level and stable during the lifting operation.

As it is known in the art, level detectors (not shown) and, more particularly, front and rear level detectors, can be installed on the shovel 20. The level detectors are used to monitor, continuously during the lifting operation, a distance to the ground and transferred the acquired height data to a control unit (not shown), such as a PLC, to which they are operatively connected. The control unit can also be operatively connected to stroke sensors (not shown) provided on each one of the front and rear lifting units of the front and rear lifting assemblies 40, 44 for measuring their extension and thereby ensure that the superstructure 21 remains level and stable during the lifting operation.

The level detectors, the stroke sensors, and the control unit can be used modify the relative lifting speed of the lifting units of the front and rear lifting assemblies 40, 44 to maintain the superstructure 21 level and stable.

FIGS. 5 and 6 show the shovel lifting apparatus 38 in a raised configuration, the superstructure 21 being detached from the undercarriage 22 and raised by the shovel lifting apparatus 38, and the undercarriage 22 remaining on the ground underneath the raised superstructure 21. In some implementations, the front and rear lifting assemblies 40, 44 raise the superstructure 21 by about 40 to 80 inches and, in some embodiments, by about 50 to 70 inches. In some implementations, the front and rear lifting assemblies 40, 44 raise the superstructure 21 by a distance to the ground sufficient to have a lower surface of the elongated beam 46 of the lifting beam 42 higher than an upper surface of the undercarriage 22, such that the undercarriage 22 can be displaced under the raised lifting beam 42.

Once the superstructure 21 is raised, maintenance operations can be performed. In some implementation, the undercarriage 22 can be driven backwards, between the rear lifting unit 44 and below the elongated beam 46 to be more accessible for the maintenance operations, as shown in FIGS. 7 and 8. Once the maintenance operations are performed, the undercarriage 22 can be driven forwards until it reaches the lifting position, under the superstructure 21. Then, the superstructure 21 can be lowered onto the undercarriage 22 by retracting the front and rear lifting assemblies 40, 42 until it contacts the undercarriage 22 and the superstructure 21 and the undercarriage 22 can be secured together, as it is known in the art.

There is provided a method for lifting a shovel 20, such as the one shown in FIGS. 1 to 8, in accordance with an embodiment. The shovel 20 has an undercarriage 22, a superstructure 21 detachably mounted to the undercarriage 22 and including a counterweight 18 at a rear end thereof, and a dipper (or bucket) 29 mounted to the superstructure 21 at a front end thereof.

The method includes configuring the shovel 20 and the lifting system 38 in a lifting configuration on a lifting site L. The lifting system 38 includes a front lifting assembly 40 and a rear lifting assembly 42. In a particular embodiment, the front lifting assembly 40 includes a set of front lifting units 43 and the rear lifting assembly 42 includes a lifting beam. In the lifting configuration, the set of front lifting units 40 matches corresponding force applying points on a front portion of the superstructure 21 and the lifting beam 42 also corresponding force applying points on an undersurface of the counterweight 18. The set of front lifting units 43 and the lifting beam 42 are operatively connected to a control unit.

The relative positioning of the shovel 20 and the lifting system 38 includes the configuration of the set of front lifting units 43 of the front lifting assembly 40 in a manner such that they abut against the undersurface of the superstructure, forwardly of a carbody 19 of the undercarriage 22, inwardly of the two endless tracks 23 of the undercarriage 22. Each one of the front lifting units 43 is located on a respective side of a central longitudinal axis X (FIG. 4) of the shovel 20. In an embodiment, the relative positioning of the shovel 20 and the lifting system 38 includes first positioning the front lifting units 43 at the lifting site L and then, driving the shovel 20 at a lifting position at the lifting site L, i.e. driving the shovel 20 towards and rearwardly of the positioned front lifting units 43 of the front lifting assembly 40.

The relative positioning of the shovel 20 and the lifting system 38 includes the configuration of the rear lifting assembly 42, including the lifting beam 44, in a manner such that it abuts against the undersurface of the counterweight 18, adjacent to a rear end thereof. In a particular embodiment, each one of the rear lifting units 44 is positioned outwardly (along the transversal axis extending perpendicular to the longitudinal axis X of the shovel 20) of the two endless tracks 23 in a manner such that a spacing between two rear lifting units 44 supporting an elongated beam 46 of the lifting beam 42 is greater than a width of the undercarriage 22.

In an embodiment, the relative positioning of the shovel 20 and the lifting system 38 includes first positioning the rear lifting units 44 at the lifting site L and then, driving the shovel 20 at the lifting position at the lifting site L, i.e. driving the shovel 20 towards and forwardly of the positioned rear lifting units 44. Then, securing the elongated beam 46 to respective upper portions of the positioned rear lifting units 44.

In an alternative embodiment, the relative positioning of the shovel 20 and the lifting system 38 includes first driving the shovel 20 at the lifting position to the lifting site L. Then, positioning the rear lifting units 44 at the lifting site L rearwardly of the shovel, with the elongated beam 46 extending below the counterweight 18 and, the spacing between two rear lifting units 44 being greater than the width of the undercarriage 22.

In still another the relative positioning of the shovel 20 and the lifting system 38 includes first driving the shovel 20 at the lifting position to the lifting site L. Then, positioning the front lifting assembly 40 and the rear lifting assembly 42 at the lifting site L. If the rear lifting assembly includes a lifting beam, the lifting beam is positioned rearwardly of the shovel, with the elongated beam 46 extending below the counterweight 18 and, the spacing between two rear lifting units 44 being greater than the width of the undercarriage 22.

Then, the front lifting units 43 of the front lifting assembly 40 and the lifting beam 42 are contacted respectively with the undersurfaces of the superstructure 21 and the counterweight 18 at the corresponding force applying points. Contacting the front lifting units 43 of the front lifting assembly 40 and the lifting beam 42 with the undersurfaces of the superstructure 21 and the counterweight 18 can be carried out by adding front and rear shims to upper surfaces of the front lifting units 43 of the front lifting assembly 40 and the lifting beam 42 respectively. Alternatively or in addition, contacting the front lifting units of the front lifting assembly 40 and the lifting beam 42 with the undersurfaces of the superstructure 21 and the counterweight 18 can be carried out by extending the front lifting units 43 of the front lifting assembly 40 and the rear lifting units 44 of the lifting beam 42.

Following driving the shovel to the lifting position at the lifting site L, either before or after contacting the front lifting units 43 of the front lifting assembly 40 and the lifting beam 42 with undersurfaces of the superstructure 21 and the counterweight 18, in some implementations, the method includes lowering the bucket 29 mounted to the superstructure 21 onto the raised supporting surface 50.

In other implementations, the method includes disconnecting the front attachments 25 having the bucket 29 mounted thereto or the bucket 29 from the superstructure 21.

Then, a lifting operation is started to raise the superstructure 21 to a desired height. In an embodiment, the bucket 29 is mounted to the superstructure 21 and remains on the supporting surface 50 for a duration of the lifting operation.

In some implementations, the bucket 29 be unsupported, above the ground surface when the lifting operation is started and can remain in such a state during the entire lifting and maintenance operations.

In other implementations, the front attachments having the bucket 29 mounted thereto or solely the bucket 92 are detached from the superstructure 21 before carrying out the lifting operation and the lifting operation is carried out on the superstructure free of at least one of the front attachments 25 and the bucket 29.

In an embodiment, the desired height is between about 40 to 80 inches and, in some embodiments, between about 50 to 70 inches. In an embodiment, the desired height is higher than a height of an upper surface of the undercarriage 22.

In an embodiment, following driving the shovel 20 to the lifting position at the lifting site L, i.e. following following positioning the shovel 20 at the lifting position at the lifting site L, detaching the superstructure 21 from the undercarriage 20.

In some implementations wherein the undercarriage 22 is detached from the superstructure 21, the undercarriage 22 can be removed from under the superstructure 21 once the latter is raised. Removing the undercarriage 22 from underneath the raised superstructure 21 can be carried out by driving backwards the undercarriage 22, via the space defined between the rear lifting units 44 and under the elongated beam 46 spacing the spaced between the rear lifting units 44. It is appreciated that, in an alternative embodiment (not shown), the undercarriage 22 can be driven laterally, in a spacing between the front and the rear lifting assemblies 40, 42. In the embodiment wherein the front lifting assembly 40 includes a front lifting beam and the front attachments 25 having the bucket 29 mounted thereto are detached and removed for the lifting operation, the undercarriage 22 can be driven forwardly, in a spacing between the front lifting units and below the front elongated beam.

Referring now to FIGS. 9 to 14, there is shown an alternative embodiment of the shovel lifting apparatus 38, wherein the features are numbered with reference numerals in the 100 series which correspond to the reference numerals of the previous embodiment.

In the shovel lifting apparatus 138, the front lifting assembly 140 includes a lifting beam 141 extending between the two spaced-apart front lifting units 143. To perform a lifting operation, each one of the front lifting units 143 is positioned on a respective side of the superstructure 21 of the shovel 20, outwardly of the two endless tracks 23, with an elongated beam 145 extending inbetween and under the superstructure 21, forwardly of the carbody 19. In such embodiment, the front lifting beam 141 and, more particularly an upper surface of the elongated beam 145 thereof is configured to abut the undersurface of the superstructure 21 and, in a particular embodiment, directly abuts s the undersurface of the superstructure 21.

Figure 10:
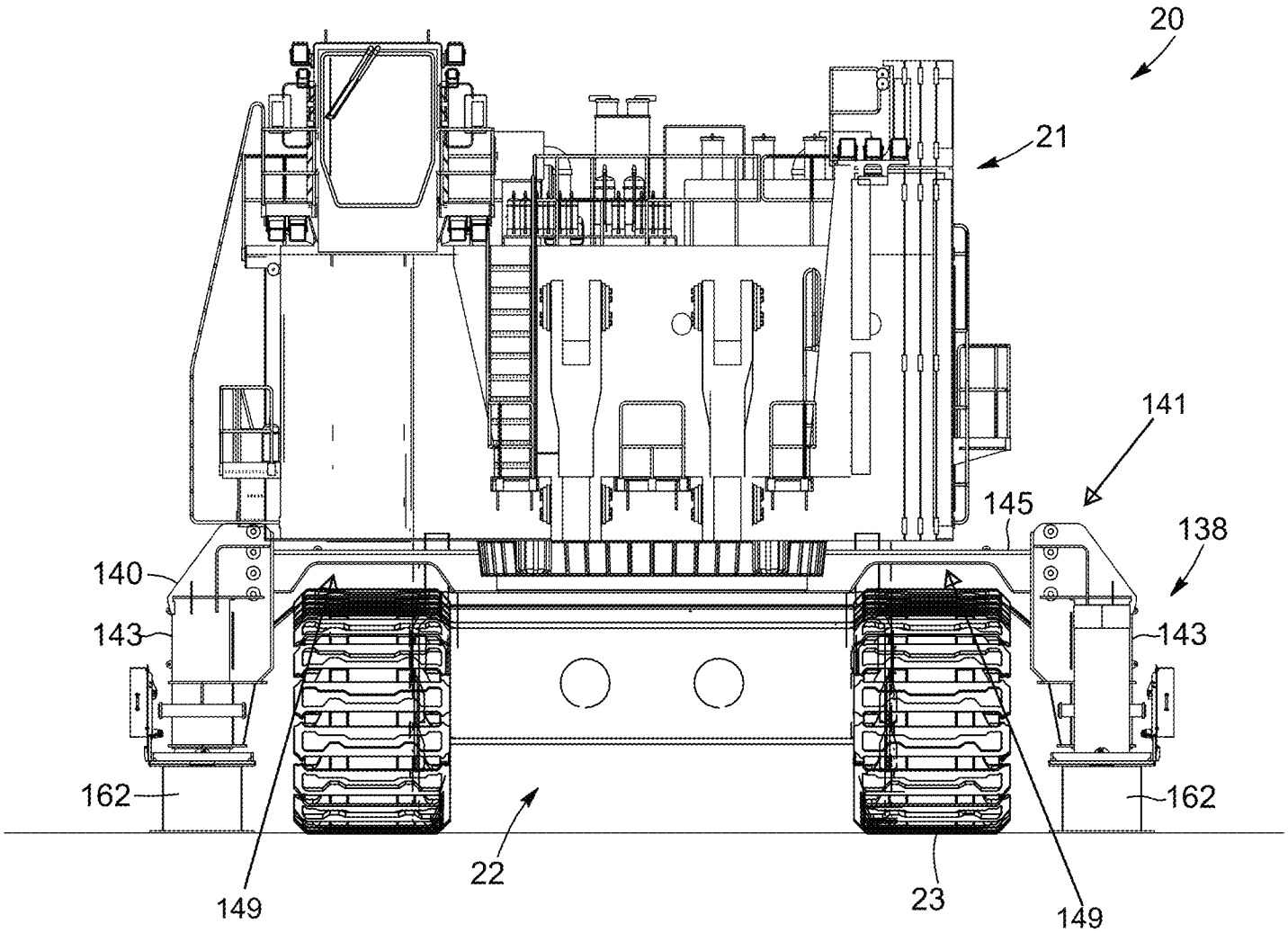
FIG. 10 is a front elevation view of the hydraulic shovel with the shovel lifting apparatus of FIG. 9, wherein a bucket and front attachments of the shovel have been omitted.
Figure 11:
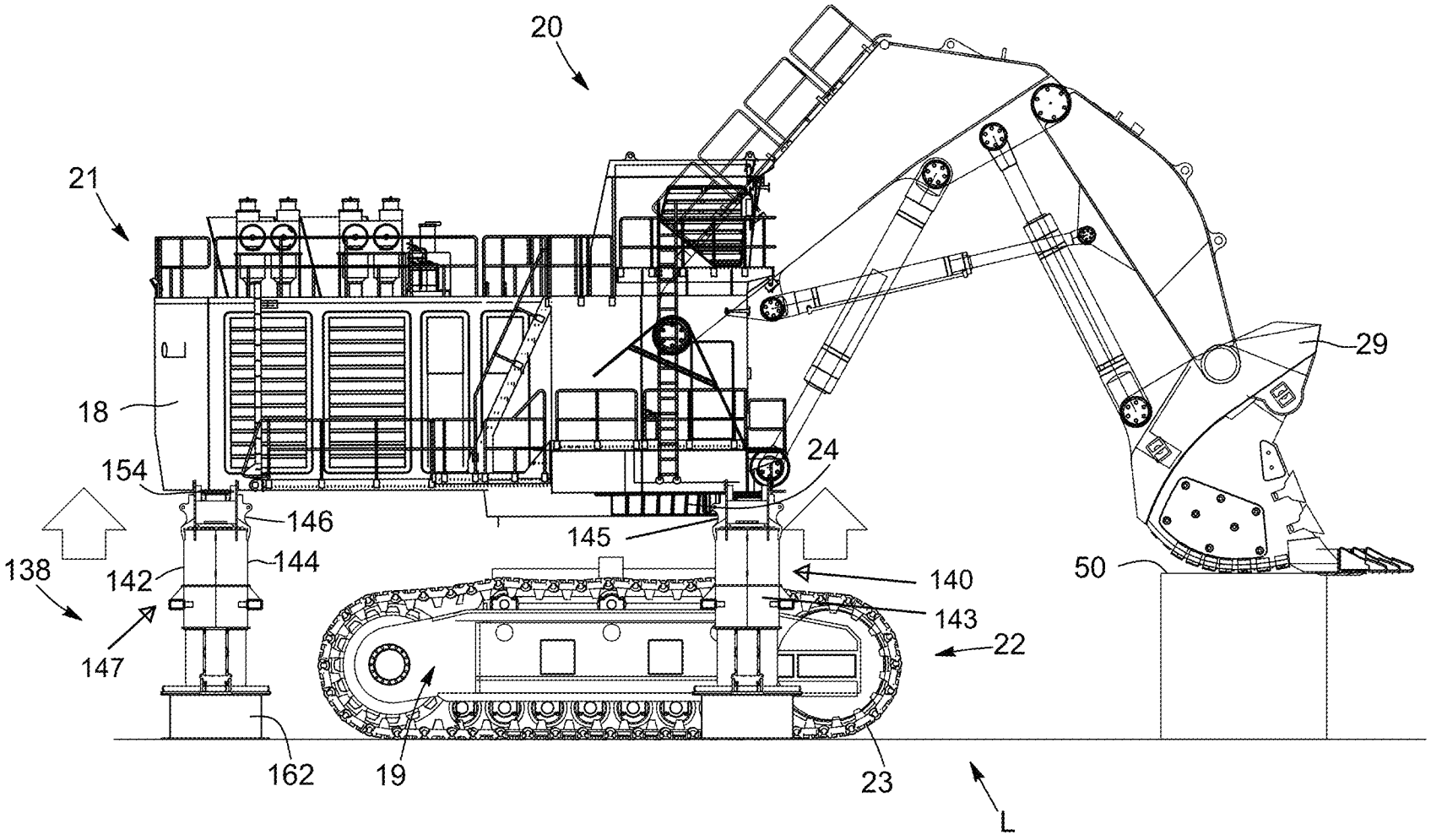
FIG. 11 is a side elevation view of the hydraulic shovel with the shovel lifting apparatus of FIG. 9, wherein a superstructure and an undercarriage of the shovel are detached and the superstructure is raised relative to the ground and the undercarriage.
Figure 12:
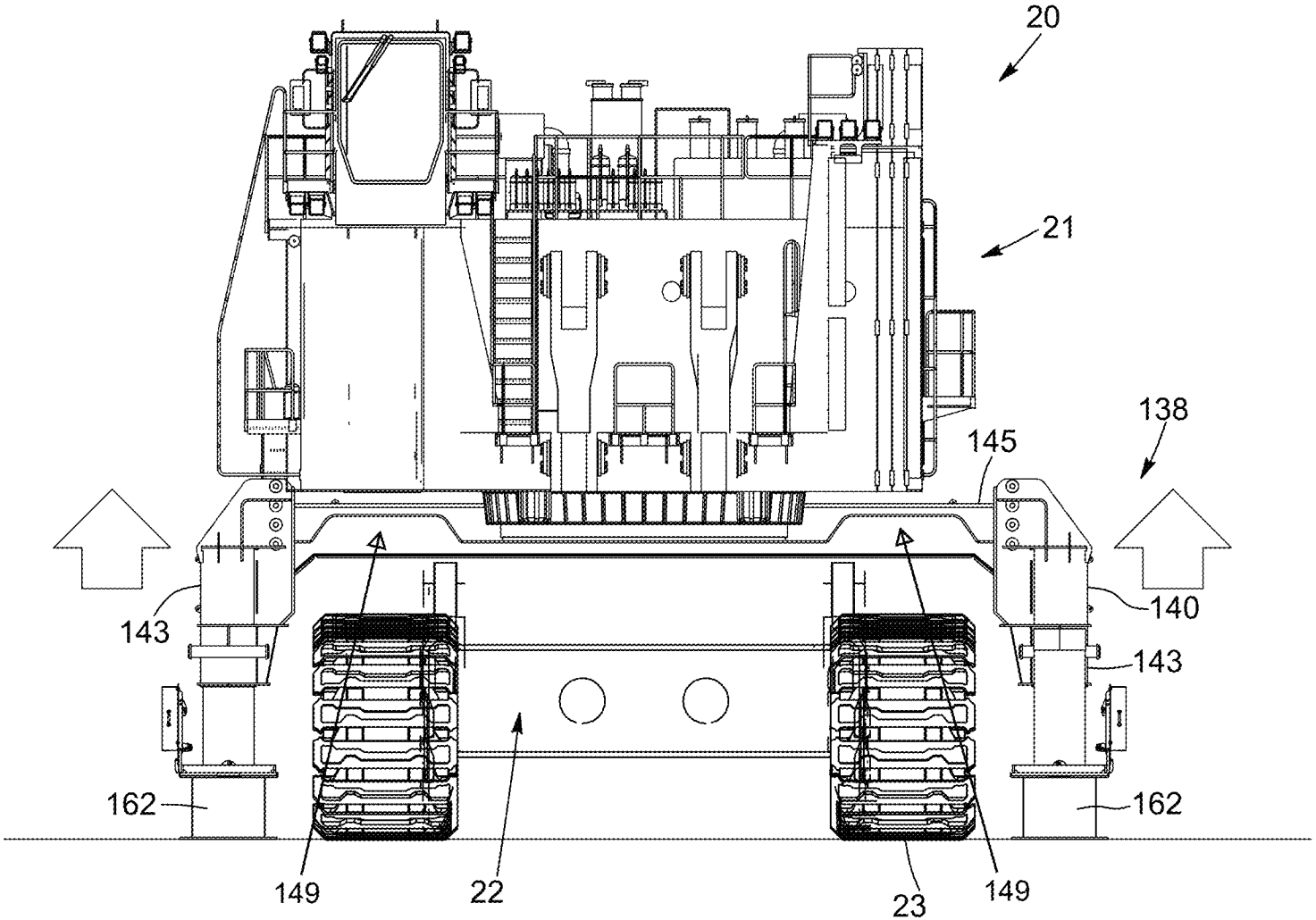
FIG. 12 is a front elevation view of the hydraulic shovel with the shovel lifting apparatus of FIG. 11, wherein the bucket and front attachments have been omitted.
Figure 13:
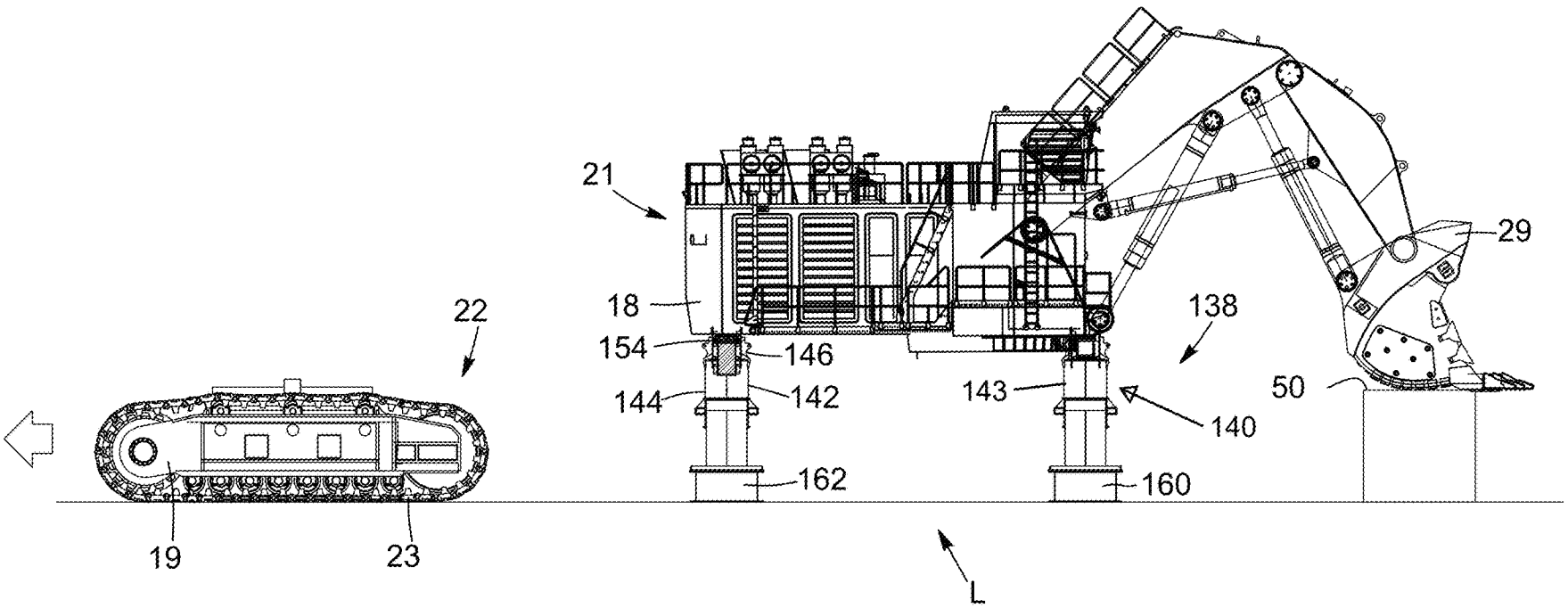
FIG. 13 is a side elevation view of the hydraulic shovel with the shovel lifting apparatus of FIG. 9, wherein the undercarriage is located behind the raised superstructure.
Figure 14:
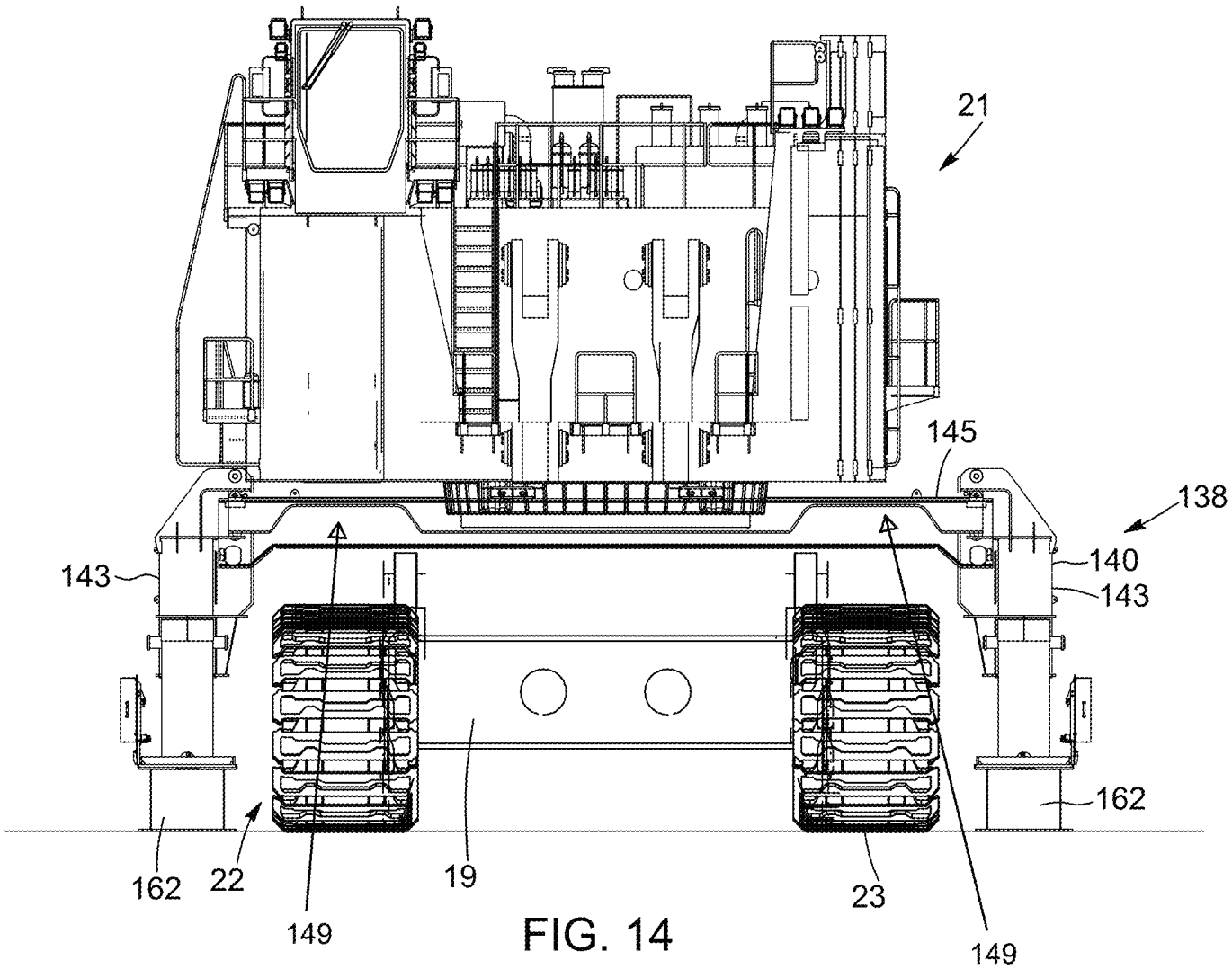
FIG. 14 is a front elevation view of the hydraulic shovel with the shovel lifting apparatus of FIG. 13, wherein the bucket and front attachments have been omitted.

As shown in FIGS. 10, 12, and 14, to clear the endless tracks 23 when positioning/configuring the front lifting assembly 140 and the shovel 20 in the lifting configuration at the lifting site L wherein the front lifting assembly 140 matches corresponding force applying points on the front portion of the undersurface of the superstructure 21, the elongated beam 145 has a non-rectangular profile, with two recesses 149 extending inwardly from a lower surface of the elongated beam 145 and being aligned with a respective one of the endless tracks 23 in the lifting configuration. Therefore, a distance between the two recesses 149 substantially corresponds to a distance between endless tracks 23 of the undercarriage 22 of the shovel 20. It is appreciated that, in an alternative embodiment (not shown), the elongated beam can be free of recesses (being sufficiently thin to be inserted between the tracks 23 and the superstructure 21) or include a single continuous recess to clear the endless tracks 23.

Figure 9:
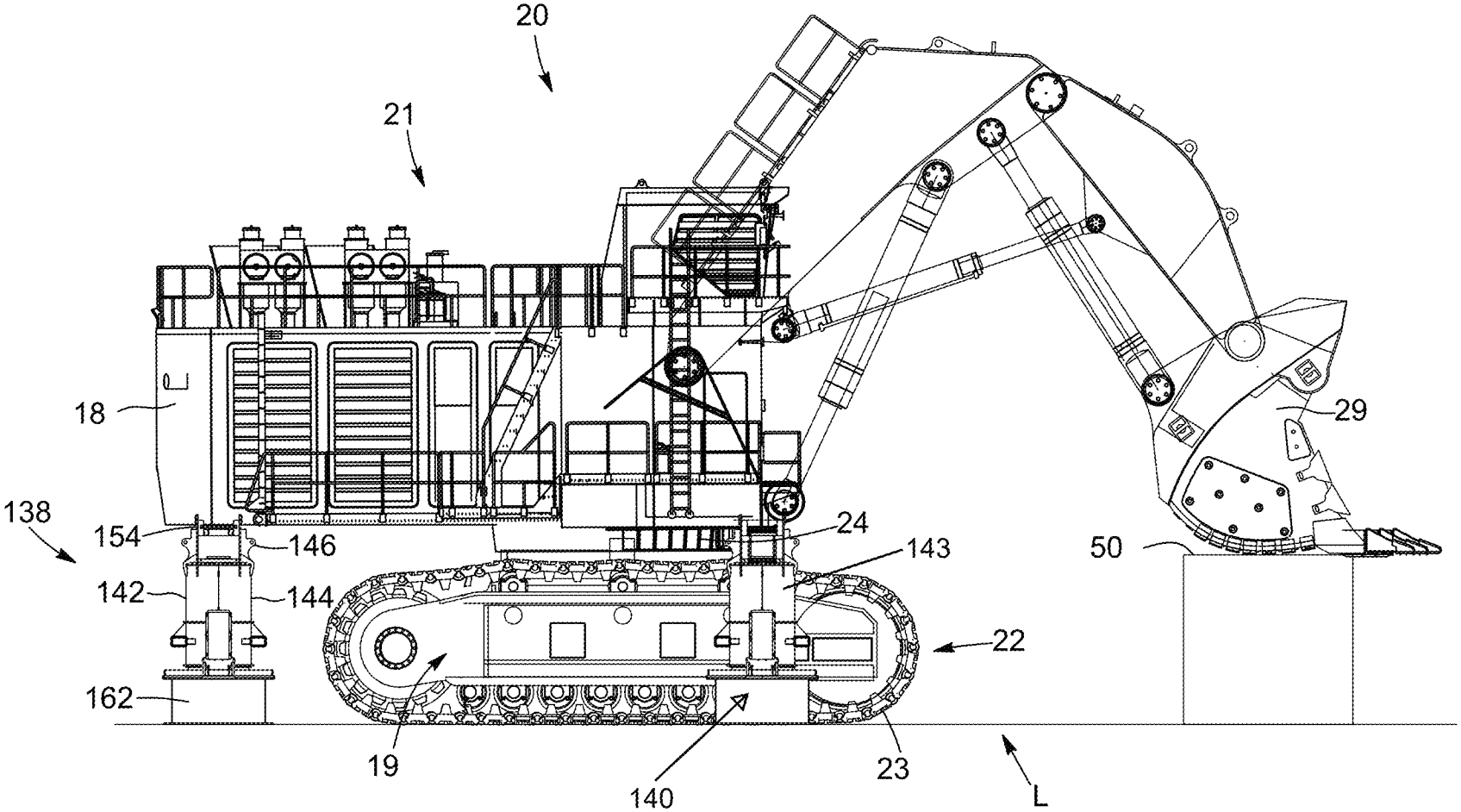
FIG. 9 is a side elevation view of a hydraulic shovel with a shovel lifting apparatus in accordance with another embodiment prior to the lifting operation in the lifting configuration at the lifting site, wherein the shovel lifting apparatus includes a front lifting beam.

In the side elevation view of FIG. 9, there is shown that the elongated beam 145 is aligned with the front portion of the superstructure 21, abutting the undersurface thereof. Thus, the elongated beams 145, 146 of the front and rear lifting assemblies 140, 142 apply an upward and vertical trust directly to the undersurfaces of the superstructure 21 and the counterweight 18, as represented by the arrows in FIGS. 11 and 12. As for the above-described embodiment, once the superstructure 21 is raised, the undercarriage 22 can be removed from under the superstructure 21. In the embodiment shown in FIGS. 13 and 14, the undercarriage 22 is displaced rearwardly. However, it is appreciated that, in alternative embodiments, it can be displaced laterally or forwardly. In the embodiment shown in FIGS. 9 to 14, the bucket 29 and the front attachments 25 remains mounted to the superstructure 21 for a duration of the lifting operation with the bucket 29 resting on the supporting surface 50 for a duration of the lifting operation. However, in an alternative embodiment (not shown), at least one of the bucket 29 and the front attachments 25 can be detached from the superstructure 21 for the lifting operation.

In the embodiment of FIGS. 9 to 14, the rear lifting assembly 142 includes the rear lifting beam 147. However, it is appreciated that, in an alternative embodiment (not shown), the rear lifting assembly 142 can include a set of spaced-apart rear lifting units, unconnected by an elongated beam, which can positioned be directly under the counterweight 18.

In the embodiments of the shovel lifting apparatuses, 38, 138, the front and the rear lifting assemblies 40, 140, 42, 142 are aligned with the superstructure 21 and the counterweight 18 in the lifting configuration. They are not located or forwardly extend or rearwardly of the superstructure 21 and the counterweight 18 respectively. Either the lifting units of the front and the rear lifting assemblies 40, 140, 42, 142 apply a vertical trust directly to the superstructure 21 and the counterweight 18 respectively, by contacting their undersurface or the lifting units of the front and the rear lifting assemblies 40, 140, 42, 142 apply the vertical trust via an elongated beam extending between the two transversally spaced-apart lifting units of a set.

The above-described lifting apparatuses and associated lifting method can allow removing the undercarriage 22 from underneath the raised superstructure 21 to ease the maintenance operation without the use of lifting jig or other similar devices which must be secured to the shovel 20 before carrying out the lifting operation. Lifting jigs are secured a to shovel to perform servicing operations. More particularly, the lifting jig provides a trust surface configured to receive a lifting force during a lifting operation and transfer the load to the superstructure of the shovel. By avoiding the attachment of a lifting jig to the shovel to perform a lifting operation, the above-described lifting apparatuses and associated lifting method can reduce downtime and provide cost-savings.

In the above description, an embodiment is an example or implementation of the inventions. The various appearances of "one embodiment," "an embodiment" or "some embodiments" do not necessarily all refer to the same embodiments.

Although various features of the invention may be described in the context of a single embodiment, the features any suitable may also be provided separately or in a combination. Conversely, although the invention may be described herein in the context of separate embodiments for clarity, the invention may also be implemented in a single embodiment.

Reference in the specification to "some embodiments", "an embodiment", "one embodiment" or "other embodiments" means that a particular feature, structure, or characteristic described in connection with the embodiments is included in at least some embodiments, but not necessarily all embodiments, of the inventions.

It is to be understood that the phraseology and terminology employed herein is not to be construed as limiting and are for descriptive purpose only.

The principles and uses of the teachings of the present invention may be better understood with reference to the accompanying description, figures and examples.

It is to be understood that the details set forth herein do not construe a limitation to an application of the invention.

Furthermore, it is to be understood that the invention can be carried out or practiced in various ways and that the invention can be implemented in embodiments other than the ones outlined in the description above.

It is to be understood that the terms "including", "comprising", "consisting" and grammatical variants thereof do not preclude the addition of one or more components, features, steps, or integers or groups thereof and that the terms are to be construed as specifying components, features, steps or integers.

If the specification or claims refer to "an additional" element, that does not preclude there being more than one of the additional element.

It is to be understood that where the claims or specification refer to "a" or "an" element, such reference is not be construed that there is only one of that element.

It is to be understood that where the specification states that a component, feature, structure, or characteristic "may", "might", "can" or "could" be included, that particular component, feature, structure, or characteristic is not required to be included.

It will be appreciated that the methods described herein may be performed in the described order, or in any suitable order.

Several alternative embodiments and examples have been described and illustrated herein. The embodiments of the invention described above are intended to be exemplary only. A person of ordinary skill in the art would appreciate the features of the individual embodiments, and the possible combinations and variations of the components. A person of ordinary skill in the art would further appreciate that any of the embodiments could be provided in any combination with the other embodiments disclosed herein. It is understood that the invention may be embodied in other specific forms without departing from the central characteristics thereof. The present examples and embodiments, therefore, are to be considered in all respects as illustrative and not restrictive, and the invention is not to be limited to the details given herein. Accordingly, while the specific embodiments have been illustrated and described, numerous modifications come to mind. The scope of the invention is therefore intended to be limited solely by the scope of the appended claims.

The invention claimed is:

1. A method of lifting a shovel comprising an undercarriage and a superstructure with a counterweight, the method comprising:

configuring the shovel and a lifting system including a front lifting assembly and a rear lifting assembly on a lifting site in a lifting configuration wherein the front lifting assembly comprises a set of front lifting units located under a front portion of the superstructure and between two endless tracks of the undercarriage, and wherein each one of the front lifting units is vertically aligned with a corresponding force applying points on the front portion of an undersurface of the superstructure and the rear lifting assembly comprises a lifting beam including a set of spaced-apart lifting units positioned outwardly of the two endless tracks of the undercarriage and an elongated beam extending inbetween wherein the elongated beam matches corresponding force applying points on an undersurface of the counterweight, wherein a spacing between the lifting units of the rear lifting assembly is greater than a width of the undercarriage;

contacting the front lifting assembly and the rear lifting assembly with the corresponding force applying points on the front portion of the undersurface of the superstructure and the undersurface of the counterweight respectively; and starting a lifting operation to raise the superstructure to a desired height.

2. The method of claim 1, wherein the shovel comprises a bucket mounted to the superstructure and the bucket remains mounted to the superstructure for the duration of the lifting operation.

3. The method of claim 1, wherein contacting the set of front lifting units and the elongated beam with the corresponding force applying points on the front portion of the superstructure and the counterweight comprises adding front and rear shims to upper surfaces of the front lifting units and the elongated beam.

4. The method of claim 1, wherein configuring the shovel and the lifting system in the lifting configuration at the lifting site comprises positioning the front lifting assembly at the lifting site and, then, driving the shovel at a lifting position at the lifting site, the front lifting assembly being located forwardly of a carbody of the undercarriage.

5. The method of claim 1, wherein configuring the shovel and the lifting system in the lifting configuration at the lifting site comprises positioning the lifting beam.

6. The method of claim 5, wherein configuring the shovel and the lifting system in the lifting configuration at the lifting site comprises positioning the lifting units of the lifting beam at the lifting site and, then, driving the shovel at the lifting position at the lifting site and securing the elongated beam of the lifting beam to respective upper portions of the positioned lifting units of the lifting beam, the lifting beam extending below the counterweight.

7. The method of claim 5, wherein configuring the shovel and the lifting system in the lifting configuration at the lifting site comprises driving the shovel at the lifting position to the lifting site and, then, positioning the lifting beam at the lifting site rearwardly of the shovel, with the elongated beam of the lifting beam extending below the counterweight.

8. The method of claim 1, further comprising, following positioning the shovel at a lifting position at the lifting site, detaching the superstructure from the undercarriage.

9. The method of claim 8, further comprising driving at least one of rearwardly, forwardly and laterally the undercarriage under the lifting beam and outside the lifting site once the superstructure is raised.

10. The method of claim 2, further comprising lowering the bucket mounted to the superstructure onto a supporting surface and maintaining the bucket on the supporting surface and mounted to the superstructure for a duration of the lifting operation.

11. The method of claim 1, wherein the force applying points for the front lifting assembly are next to a rolling circle of the shovel.

12. The method of claim 1, wherein the shovel is a hydraulic shovel.

13. The method of claim 1, wherein the front lifting assembly is free of a mechanical connection extending between the front lifting units.

14. The method of claim 1, wherein the superstructure is unsecured to the front lifting assembly during the lifting operation.

15. The method of claim 1, further comprising withdrawing the undercarriage from the lifting site once the superstructure is raised to the desired height by displacing the undercarriage under the elongated beam and between the lifting units of the rear lifting assembly.

16. An apparatus for lifting a superstructure of a shovel, separated from an undercarriage, from a ground surface, the shovel comprising the undercarriage and the superstructure with a counterweight, the apparatus comprising:

a set of front lifting units abuttable against an undersurface of a front portion of the superstructure, located between two endless tracks of the undercarriage and next to a rolling circle of the shovel;

a lifting beam including a set of rear lifting units located outside of the endless tracks of the undercarriage and an elongated beam extending between upper portions of the rear lifting units, a spacing between the rear lifting units being greater than a width of the undercarriage allowing the undercarriage to circulate between the rear lifting units and the elongated beam, the lifting beam being abuttable against an undersurface of the counterweight; and a control unit operatively connected to the set of front lifting units and the lifting beam.

17. The apparatus of claim 16, wherein the elongated beam of the lifting beam is detachable from the rear lifting units.

18. The apparatus of claim 16, wherein the shovel is a hydraulic shovel.

19. The apparatus of claim 16, wherein the front lifting assembly is free of a mechanical connection extending between the front lifting units.

20. The apparatus of claim 16, wherein the front lifting assembly is free of a mechanical connection extending between the front lifting units and the superstructure during a lifting operation.

* * * * *